US011428091B2

(12) United States Patent
Frost et al.

(10) Patent No.: US 11,428,091 B2
(45) Date of Patent: Aug. 30, 2022

(54) ABOVE PACKER GAS SEPARATION

(71) Applicant: ODESSA SEPARATOR, INC., Odessa, TX (US)

(72) Inventors: Cavin B. Frost, Odessa, TX (US); Daniel L. Culbertson, Odessa, TX (US); Dañelle N. Campbell, Odessa, TX (US); Lowell C. Kirkland, Odessa, TX (US); Gustavo A. Gonzalez-Cabrera, Midland, TX (US)

(73) Assignee: Odessa Separator, Inc., Odessa, TX (US)

( * ) Notice: Subject to any disclaimer, the term of this patent is extended or adjusted under 35 U.S.C. 154(b) by 68 days.

(21) Appl. No.: 16/713,278

(22) Filed: Dec. 13, 2019

(65) Prior Publication Data

US 2020/0208506 A1 Jul. 2, 2020

Related U.S. Application Data

(60) Provisional application No. 62/785,212, filed on Dec. 26, 2018.

(51) Int. Cl.

| | |
|---|---|
| ***E21B 43/38*** | (2006.01) |
| ***E21B 43/12*** | (2006.01) |
| ***E21B 33/12*** | (2006.01) |

(52) U.S. Cl.

CPC ..... *E21B 43/38* (2013.01); *E21B 33/12* (2013.01); *E21B 43/121* (2013.01)

(58) Field of Classification Search

CPC ..... E21B 43/38; E21B 43/35; E21B 43/34

See application file for complete search history.

(56) References Cited

U.S. PATENT DOCUMENTS

| | | | | |
|---|---|---|---|---|
| 2,883,940 | A | 4/1959 | Gibson | |
| 3,624,822 | A * | 11/1971 | Carle | E21B 43/38 417/313 |
| 4,231,767 | A | 11/1980 | Acker | |
| 5,154,588 | A | 10/1992 | Freet et al. | |

(Continued)

OTHER PUBLICATIONS

Odessa Separator, Inc.; "Bypass Valve/ Intake System", company brochure, received Oct. 2, 2016, 1 page.

(Continued)

*Primary Examiner* — Catherine Loikith

(74) *Attorney, Agent, or Firm* — Smith IP Services, P.C.

(57) ABSTRACT

A gas separator can include an intake section. Splines extend radially from an inner manifold of the intake section and engage an interior surface of an outer housing, thereby isolating openings formed in the splines from longitudinal channels extending through the outer housing. Another gas separator can include an intake section, a discharge section and multiple intermediate sections connected between the intake and discharge sections. A gas separation system can include a completion string including a packer, a downhole pump and a gas separator connected between the packer and the pump. An annulus is formed between the gas separator and a wellbore, an intake section of the gas separator receives formation fluids from below the packer, a discharge section of the gas separator discharges gas and liquids into the annulus, the intake section receives the liquids from the annulus, and the pump receives the liquids from the discharge section.

23 Claims, 8 Drawing Sheets

(56) References Cited

U.S. PATENT DOCUMENTS

| | | | | |
|---|---|---|---|---|
| 5,411,088 | A | 5/1995 | LeBlanc et al. | |
| 5,482,117 | A * | 1/1996 | Kolpak | E21B 43/121 166/105.5 |
| 5,868,200 | A | 2/1999 | Bryant et al. | |
| 7,104,321 | B2 | 9/2006 | Carruth | |
| 8,881,803 | B1 | 11/2014 | Frost | |
| 10,415,360 | B2 | 9/2019 | Culbertson et al. | |
| 2013/0327528 | A1 | 12/2013 | Frost | |

OTHER PUBLICATIONS

Odessa Separator, Inc.; "Dual Body Super Gas and Sand Shield", company brochure, received Oct. 2, 2016, 1 page.
Odessa Separator, Inc.; "Gas Shield", company brochure, received Oct. 2, 2016, 1 page.
Odessa Separator, Inc.; "Slotted Gas Shield", company brochure, received Oct. 2, 2016, 1 page.
Odessa Separator, Inc.; "Super Gas and Sand Shield", company brochure, received Oct. 2, 2016, 1 page.
McCoy, J.N., et al.; "Improved Downhole Gas Separators", paper for the department of Petroleum Engineering, dated Apr. 7 & 8, 1998, 11 pages.

* cited by examiner

ABOVE PACKER GAS SEPARATION

BACKGROUND

This disclosure relates generally to equipment utilized and operations performed in conjunction with a subterranean well and, in an example described below, more particularly provides for gas separation above a production packer.

Gas separation is typically used to separate gas from formation fluids produced downhole. For example, it can be advantageous to separate the gas from the formation fluids upstream of a downhole pump, so that the gas is not introduced into the pump. In this manner, gas-lock of the pump can be prevented.

It will, thus, be readily appreciated that improvements are continually needed in the arts of gas separation, and manufacture and operation of gas separation equipment. Such improvements may be utilized whether or not a downhole pump is used to produce formation fluids to surface.

DETAILED DESCRIPTION

Figure 1:
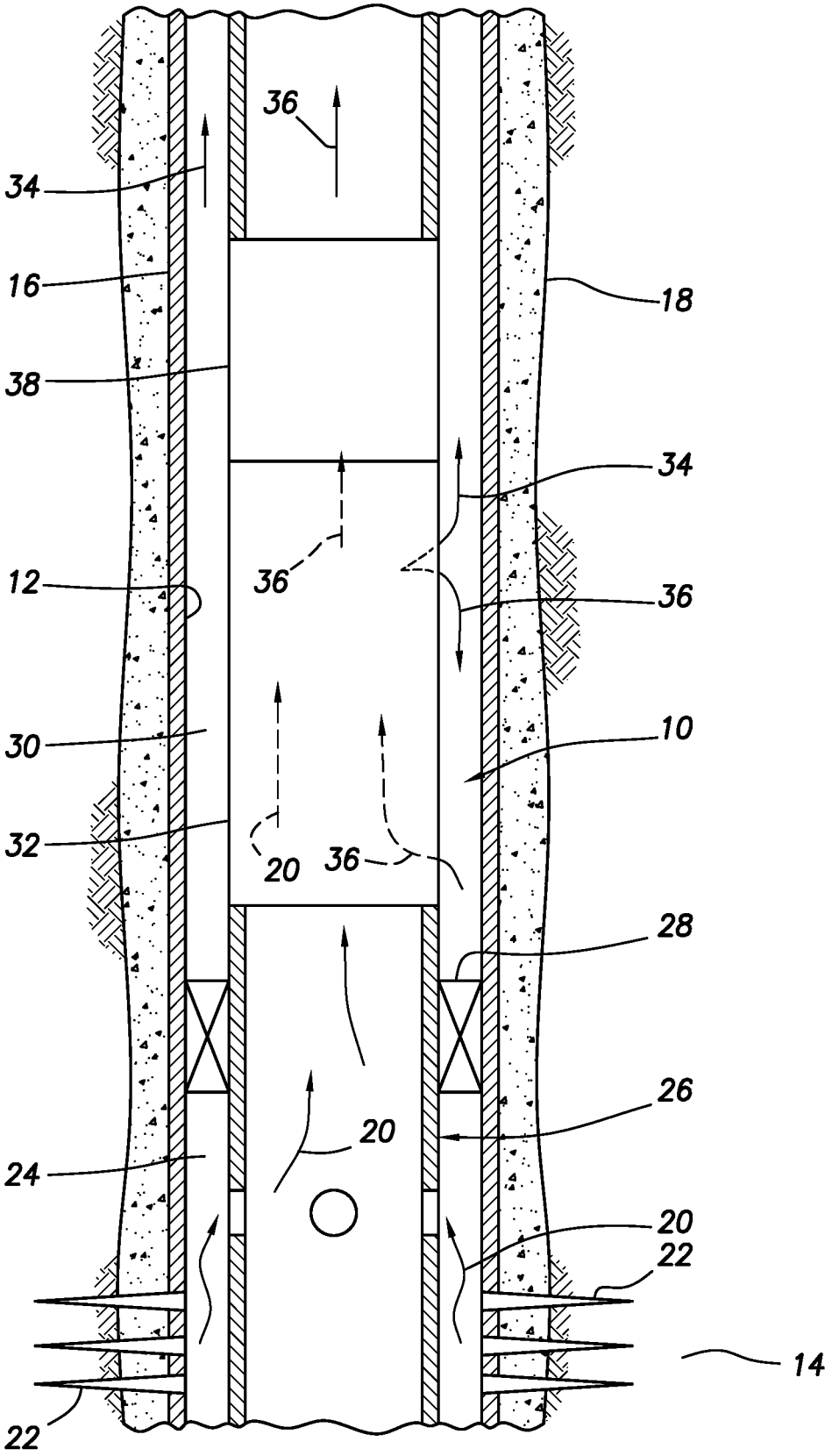
FIG. 1 is a representative partially cross-sectional view of an example of a gas separation system and associated method which can embody principles of this disclosure.

Representatively illustrated in FIG. 1 is a gas separation system 10 and associated method which can embody the principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method as described herein and/or depicted in the drawings.

As depicted in FIG. 1, a wellbore 12 penetrates an earth formation 14. The wellbore 12 in this example is lined with casing 16 and cement 18. However, in other examples, the principles of this disclosure may be practiced in an uncased, unlined or open hole wellbore.

Fluids 20 are produced from the formation 14 into the casing 16 via perforations 22. The fluids 20 may include any combination of formation fluids (such as, oil, gas, water, gas condensates, paraffins, asphaltenes, etc.), as well as particulates, sand, proppant, formation fines, etc.

In the FIG. 1 example, the fluids 20 flow through an annulus 24 formed radially between the casing 16 and a tubular completion string 26, prior to flowing into the completion string. In some examples, the completion string 26 may be provided with a well screen (such as, a wire-wrapped, mesh or sintered screen), in order to exclude any particulates, sand, proppant, formation fines, etc., from entering the completion string.

In some examples, the completion string 26 may be provided with chemical injection equipment (such as, an injection side pocket mandrel, etc.) or other chemical treatment to prevent precipitation or buildup of gas condensates, paraffins, asphaltenes, etc., in the completion string. Thus, the scope of this disclosure is not limited to the configuration of the completion string 26 as depicted in FIG. 1.

A packer 28 isolates the annulus 24 below the packer from another annulus 30 above the packer. A gas separator 32 is connected in the completion string 26 above the packer 28.

The gas separator 32 receives the fluids 20 from the completion string 26 below the packer 28 and separates any gas 34 from liquids 36 of the fluids. The gas 34 enters the annulus 30 from the gas separator 32 and flows to surface for collection (for example, from a casing valve at a wellhead).

The liquids 36 also enter the annulus 30 from the gas separator 32 but, due to the greater density of the liquids, they accumulate in the annulus 30 above the packer 28. From the annulus 30, the liquids 36 enter an intake of the gas separator 32 and flow upward through the gas separator. Note that the separated liquids 36 are isolated from the formation fluids 20 in the gas separator 32.

From the gas separator 32, the liquids 36 may flow directly to the surface via the completion string 26, or a downhole pump 38 (such as, a reciprocating rod pump or an electric submersible pump) may be connected in the completion string to pump the liquids to the surface. The scope of this disclosure is not limited to use of any particular equipment or techniques for flowing the liquids 36 from the gas separator 32 to the surface.

Figure 2:
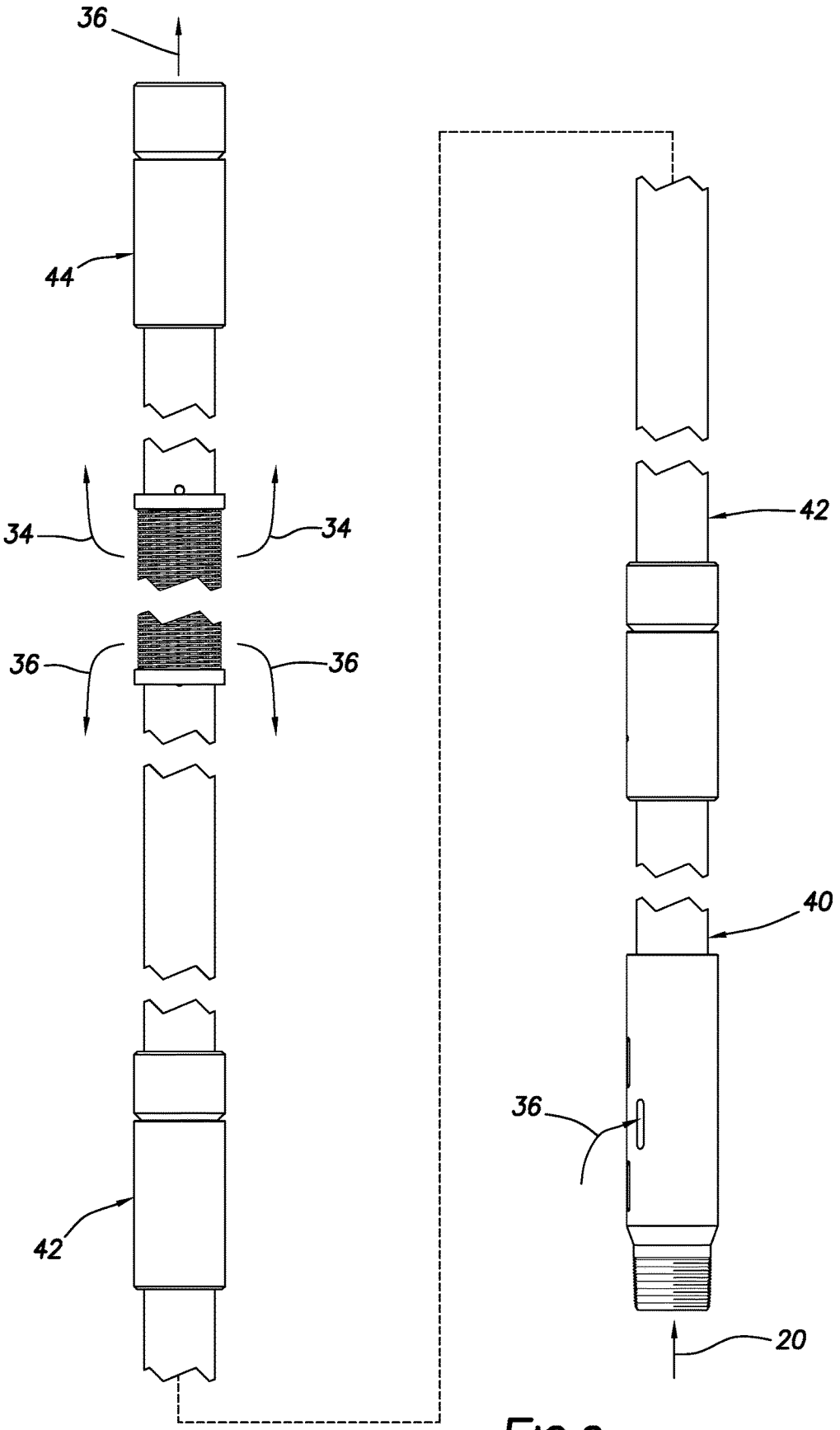
FIG. 2 is a representative elevational view of an example of a gas separator that may be used in the gas separation system of FIG. 1.

Referring additionally now to FIG. 2, a side view of an example of the gas separator 32 is representatively illustrated. The gas separator 32 may be used in the FIG. 1 system 10 and method, or it may be used in other systems and methods.

In the FIG. 2 example, the gas separator 32 includes three separate connected-together sections 40, 42, 44. The lowermost section is an intake section 40, the uppermost section is a discharge section 44, and connected between these is an intermediate section 42. Note that, although only one intermediate section 42 is depicted in FIG. 2, any number of intermediate sections may be connected between the intake and discharge sections 40, 44. Larger numbers of the intermediate section 42 may be used in situations where more gas 34 is present in the formation fluids 20.

The intake section 40 receives the fluids 20 from the packer 28 (or any tubulars connected between the packer and the gas separator 32). The fluids 20 flow upwardly through the intake section 40 and the intermediate section 42 to the discharge section 44.

The intake section 40 also receives the liquids 36 from the annulus 30 above the packer 28. The liquids 36 flow upwardly through the intake section 40, the intermediate section 42 and the discharge section 44. The liquids 36 received into the intake section 40 are isolated from the fluids 20 in the gas separator 32, as described more fully below.

Figure 3:
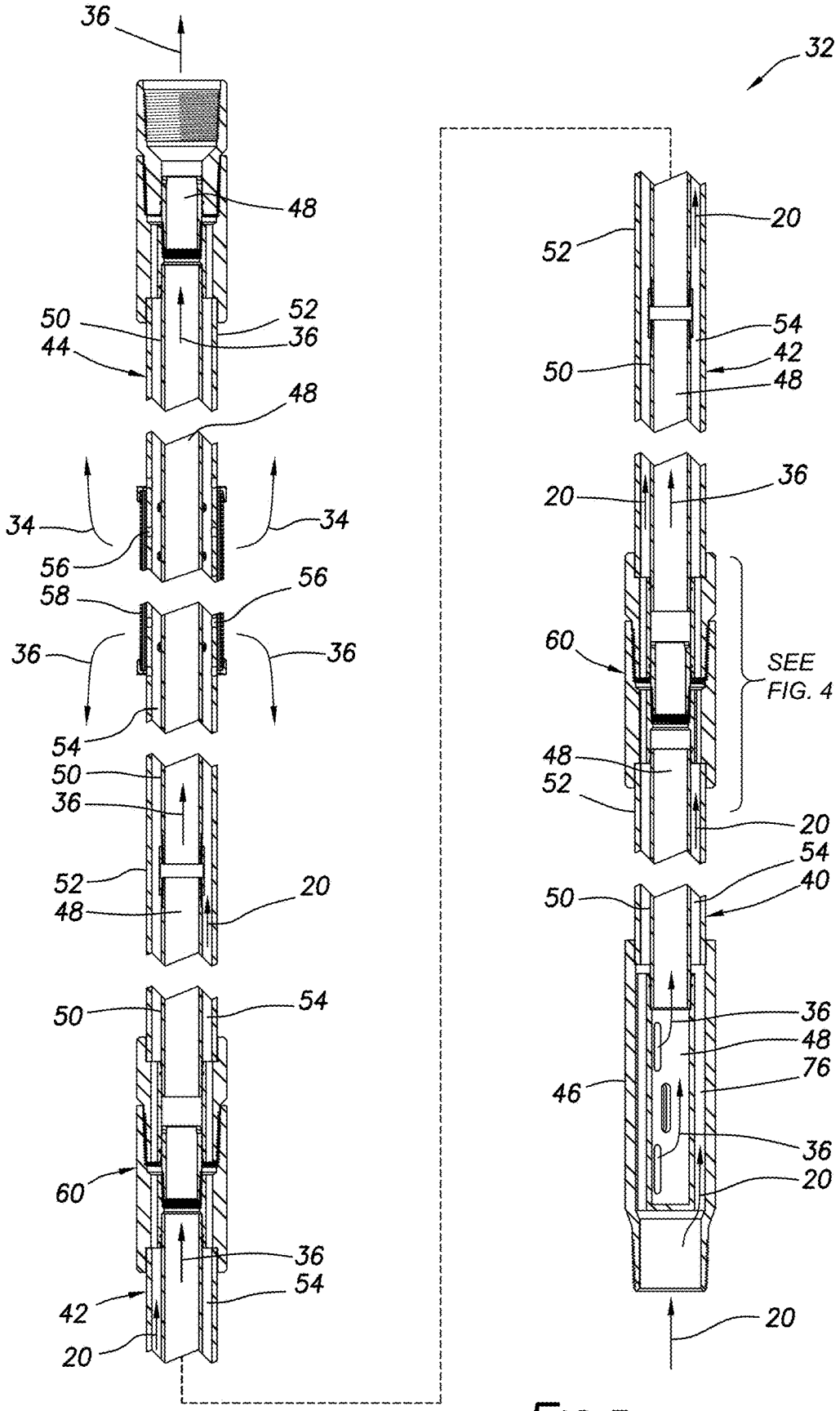
FIG. 3 is a representative cross-sectional view of the gas separator.

Referring additionally now to FIG. 3, a cross-sectional view of the gas separator 32 is representatively illustrated. In this view, the manner in which the liquids 36 are isolated from the fluids 20 in the gas separator 32 may be more clearly seen.

As depicted in FIG. 3, the intake section 40 includes a specially configured intake device 46 that receives the liquids 36 into an inner longitudinal flow passage 48, while isolating the liquids from the fluids 20 received into a lower end of the intake section. The fluids 20 flow upwardly through one or more channels 76 formed in the intake device 46. The channels 76 are isolated from the flow passage 48 in the intake device 46, as described more fully below.

The flow passage 48 extends upwardly from the intake device 46 and through a longitudinally extending inner tube 50 in the intake section 40. Similar inner tubes 50 are provided in the intermediate and discharge sections 42, 44, so that the liquids 36 can flow upwardly through the flow passage 48 extending through the intermediate and discharge sections.

The inner tubes 50 are positioned in tubular outer housings 52, so that an annulus 54 is formed radially between each of the inner tubes and the respective surrounding outer housing. The fluids 20 flow through the annulus 54 in the intake section 40 to the annulus 54 in the intermediate section 42, and then into the annulus 54 in the discharge section 44.

While the fluids 20 are in the annuli 54 of the gas separator 32, the gas 34 gradually separates from the liquids 36, due to their different densities. The annulus 54 in the discharge section 44 is blocked at its upper end, and so the gas 34 accumulates in an upper portion of the annulus in the discharge section.

Ports 56 are provided in the outer housing 52 of the discharge section 44, in order to permit the gas 34 to flow outward from the annulus 54 into the annulus 30. A screen 58 can be provided covering the ports 56 in the outer housing 52.

The liquids 36 that accumulate in the annulus 54 can also flow out of the ports 56 in the discharge section 44. The liquids 36 that flow out of the ports 56 and into the annulus 30 then accumulate in the annulus 30 as described above, and are received into the intake section 40.

Figure 4:
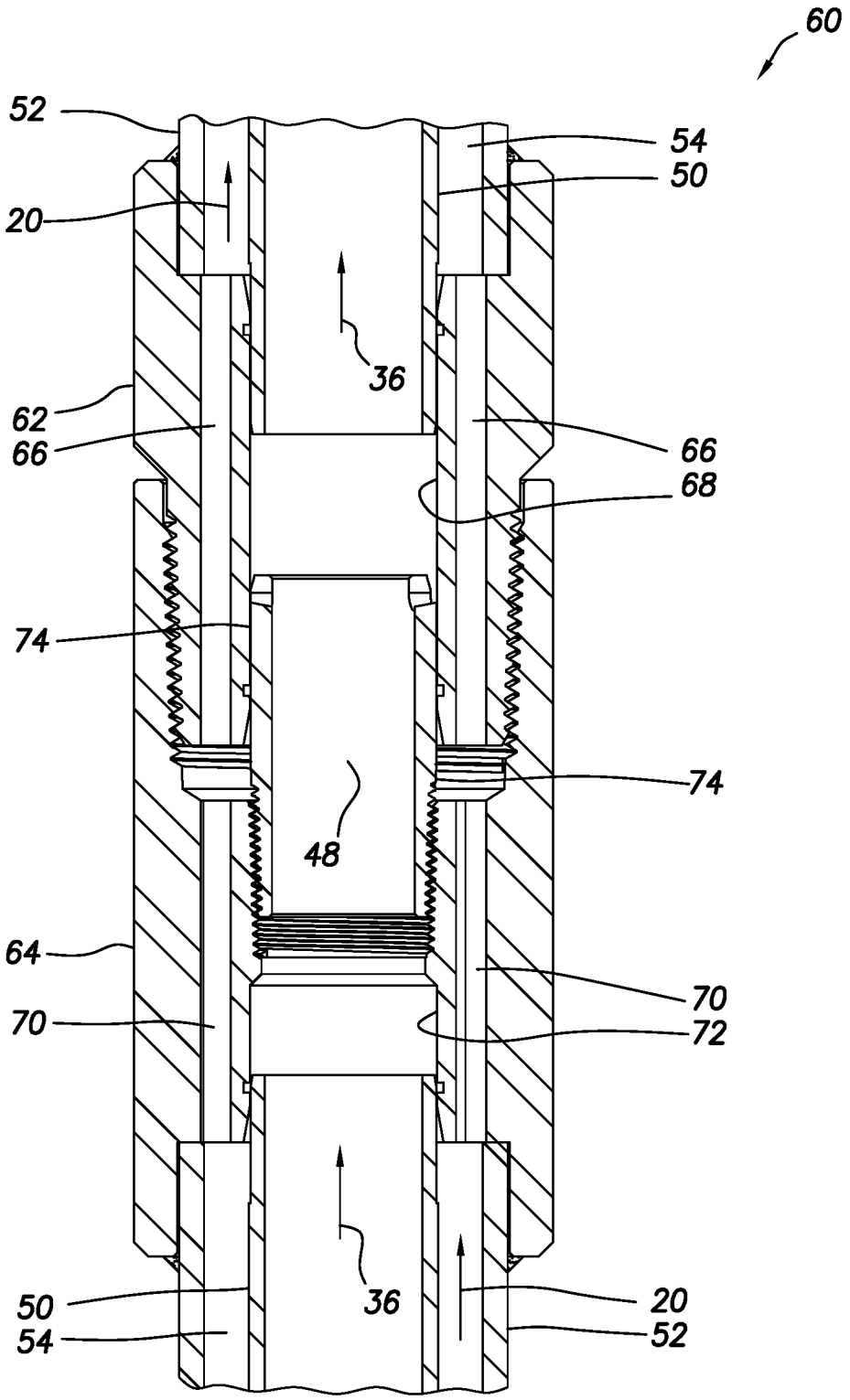
FIG. 4 is a representative cross-sectional view of an example of upper and lower connectors that may be included in the gas separator.

Referring additionally now to FIG. 4, a cross-sectional view of an example of a connection 60 used between the intake section 40 and the intermediate section 42, and between the intermediate section and the discharge section 44, is representatively illustrated. If multiple intermediate sections 42 are used, the connection 60 may also be used between each adjacent pair of the intermediate sections.

A connector 62 is secured at a lower end of an outer housing 52 (such as, by welding, threading, etc.). The connector 62 has multiple circumferentially distributed and longitudinally extending passages 66 formed therein that are in communication with the annulus 54 between the outer housing 52 and an inner tube 50.

The inner tube 50 is sealingly received in a central bore 68 formed longitudinally through the connector 62. The bore 68 is in communication with the interior of the inner tube 50, so that the flow passage 48 extends through the bore.

Note that the inner tube 50 is not secured against longitudinal displacement relative to the connector 62. This allows for some dimensional variance in the length of the inner tube 50, which in some examples may be made up of multiple connected-together sections. However, sealing engagement is maintained between the inner tube 50 and the bore 68.

Another connector 64 is secured at an upper end of an outer housing 52 (such as, by welding, threading, etc.). The connector 64 has multiple circumferentially distributed and longitudinally extending passages 70 formed therein in communication with the annulus 54 between the outer housing 52 and an inner tube 50.

The inner tube 50 is sealingly received in a central bore 72 formed longitudinally through the connector 64. The bore 72 is in communication with the interior of the inner tube 50, so that the flow passage 48 extends through the bore.

Again, the inner tube 50 is not secured against longitudinal displacement relative to the connector 64. However, sealing engagement is maintained between the inner tube 50 and the bore 72.

The bores 68, 72 are in fluid communication via a relatively short tube 74. In this example, the tube 74 is threaded into the connector 64, and is sealingly received in the bore 68 of the connector 62, so that the flow passage 48 extends through the tube 74. Thus, when the connectors 62, 64 are connected together as depicted in FIG. 4 (such as, by threading), the annuli 54 on either side of the connectors are in fluid communication with each other (via the passages 66, 70), and the interiors of the inner tubes 50 on either side of the connectors are in fluid communication with each other (via the tube 74).

Figure 5:
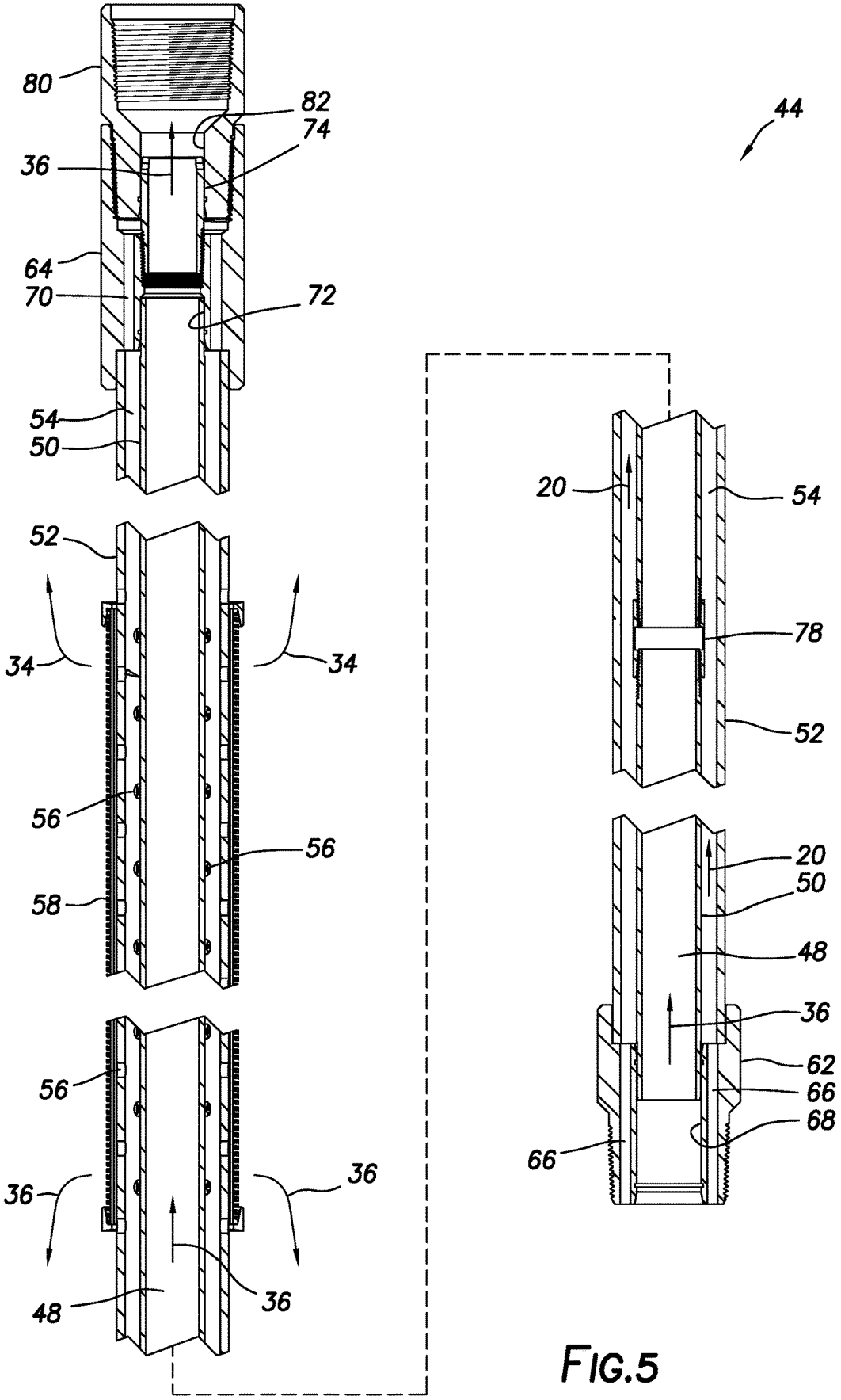
FIG. 5 is a representative cross-sectional view of an example of a discharge section that may be included in the gas separator.

Referring additionally now to FIG. 5, the discharge section 44 is representatively illustrated, apart from the remainder of the gas separator 32. In this view, it may be seen that the discharge section 44 includes an outer housing 52 surrounding two inner tubes 50. A connector 64 is connected at an upper end of the outer housing 52 and an upper one of the inner tubes 50, and a connector 62 is connected at a lower end of the outer housing and a lower one of the inner tubes.

The inner tubes 50 are connected to each other by a coupling 78. Note that any number of inner tubes 50 may be connected together in any of the gas separator sections 40, 42, 44 by use of an appropriate number of couplings 78. Since the uppermost inner tube 50 is slip fit into the bore 72 of the connector 64, and the lowermost inner tube 50 is slip fit into the bore 68 of the connector 62, dimensional variations of the inner tubes and the coupling(s) 78 are accommodated.

As described above, the outer housing 52 of the discharge section 44 has the ports 56 formed therein, and the ports are surrounded by the screen 58. Although only one set of ports 56 and screen 58 is depicted in the FIG. 5 example, any number of ports and screens could be provided in other examples. For example, an upper set of ports 56 and screen 58 could be provided, such that the upper set is specially configured for discharge of the gas 34 therethrough, and a lower set of ports and screen could be provided, such that the lower set is specially configured for discharge of the liquids 36.

Note that the annulus 54 is closed off at its upper end by an adapter 80 threaded into the connector 64. The tube 74 is sealingly received in a bore 82 of the adapter 80, so that the flow passage 48 extends upwardly through the adapter.

Thus, the liquids 36 can flow upwardly through the adapter 80 via the flow passage 48 (e.g., to the pump 38 or otherwise to the surface), but the annulus 54 is blocked by the adapter, so that the gas 34 can accumulate in the upper portion of the annulus. In other examples, instead of using the separate adapter 80, the connector 64 could be provided without the passages 70 (and without the tube 74), thereby closing off the upper end of the annulus 54.

Figure 6:
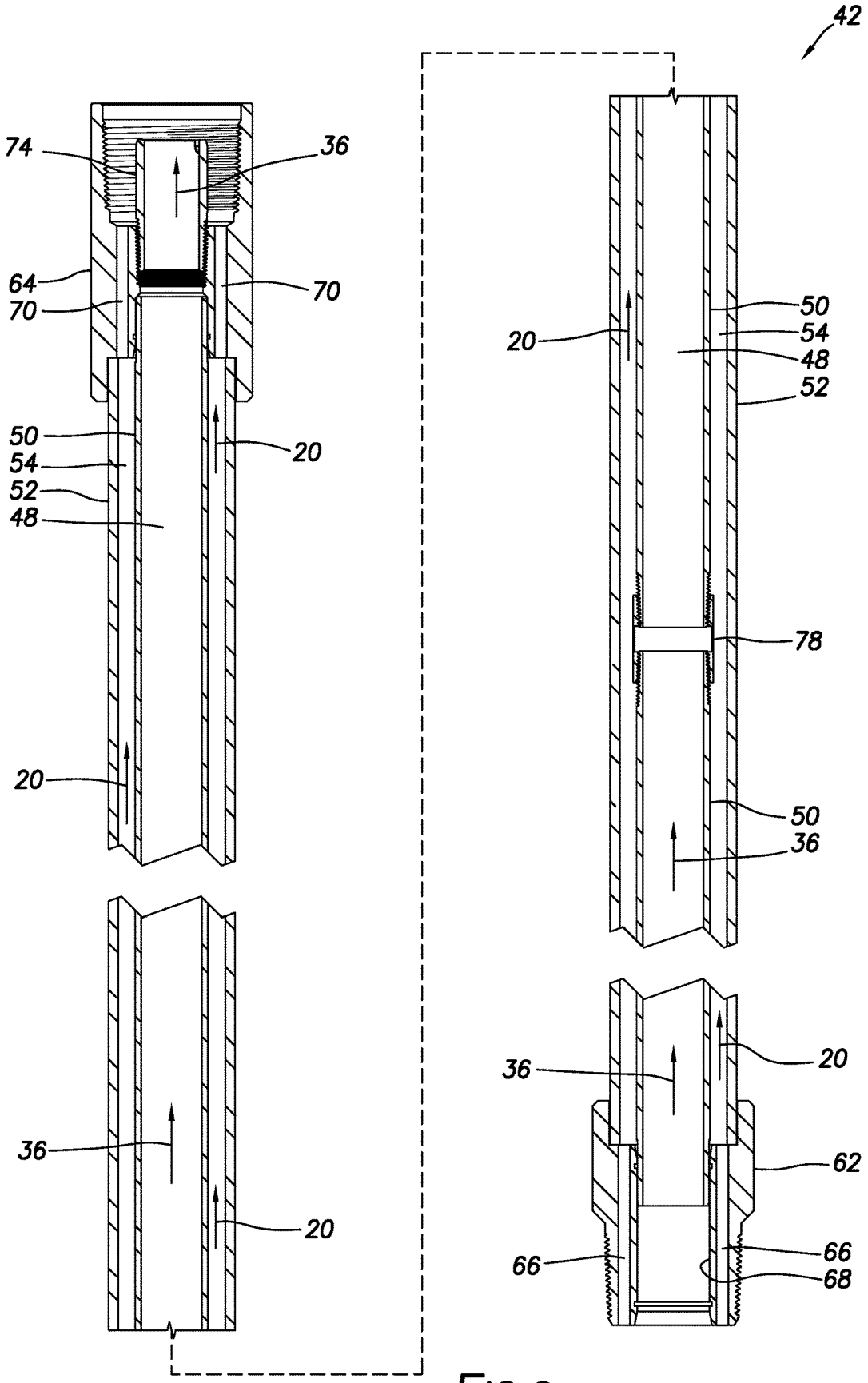
FIG. 6 is a representative cross-sectional view of an example of an intermediate section that may be included in the gas separator.

Referring additionally now to FIG. 6, the intermediate section 42 is representatively illustrated, apart from the remainder of the gas separator 32. In this view, it may be seen that the intermediate section 42 includes an outer housing 52 surrounding two inner tubes 50. A connector 64 is connected at an upper end of the outer housing 52 and an upper one of the inner tubes 50, and a connector 62 is connected at a lower end of the outer housing and a lower one of the inner tubes.

The inner tubes 50 are connected to each other by a coupling 78. Any number of inner tubes 50 may be connected together in the intermediate section 42 by use of an appropriate number of couplings 78. Since the uppermost inner tube 50 is slip fit into the bore 72 of the connector 64, and the lowermost inner tube 50 is slip fit into the bore 68 of the connector 62, dimensional variations of the inner tubes and the coupling(s) 78 are accommodated.

As mentioned above, any number of the intermediate sections 42 may be used between the intake section 40 and the discharge section 44. To connect any of the sections to another section, a connector 62 of one section is connected to a connector 64 of another section (as depicted in FIG. 4), to thereby provide for fluid communication between the flow passages 48 on either side of the connectors, and to provide for fluid communication between the annuli 54 on either side of the connectors.

Figure 7:
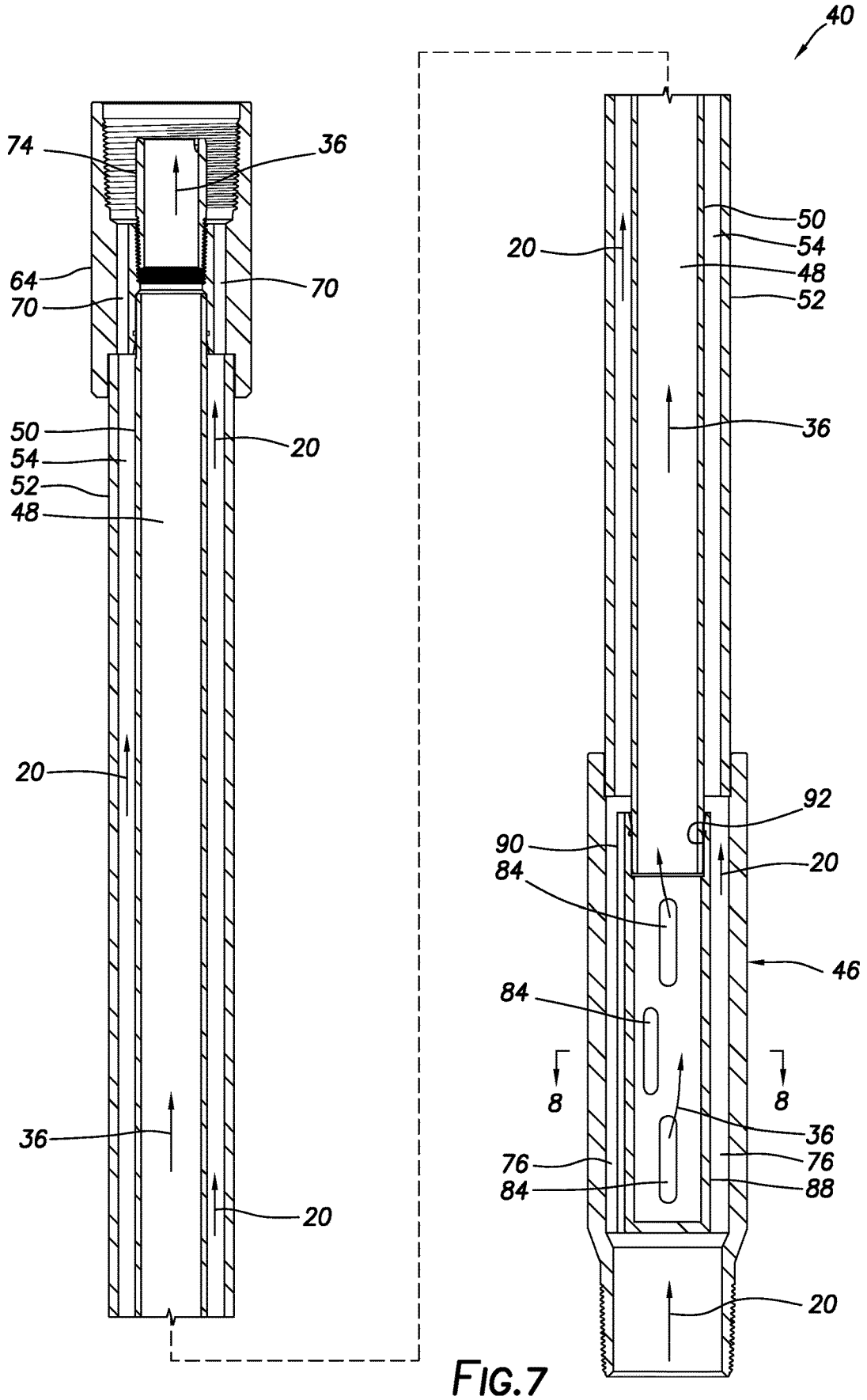
FIG. 7 is a representative cross-sectional view of an example of an intake section that may be included in the gas separator.

Referring additionally now to FIG. 7, the intake section 40 is representatively illustrated, apart from the remainder of the gas separator 32. In this view, it may be seen that the intake section 40 includes an outer housing 52 surrounding an inner tube 50.

A connector 64 is connected at an upper end of the outer housing 52 and an upper end of the inner tube 50. The intake device 46 is connected at a lower end of the outer housing 52 and a lower end of the inner tube 50.

As described above, the intake device 46 includes the channels 76, which permit the fluids 20 to flow upwardly through the intake device to the annulus 54 between the inner tube 50 and the outer housing 52. The channels 76 are isolated from the flow passage 48 in the intake device 46, as described more fully below.

Openings 84 in the intake device 46 permit the liquids 36 to flow from an exterior of the intake device (e.g., the annulus 30) to an interior of the intake device (e.g., the flow passage 48). The openings 84 are isolated from the channels 76 in the intake device 46.

Figure 8:
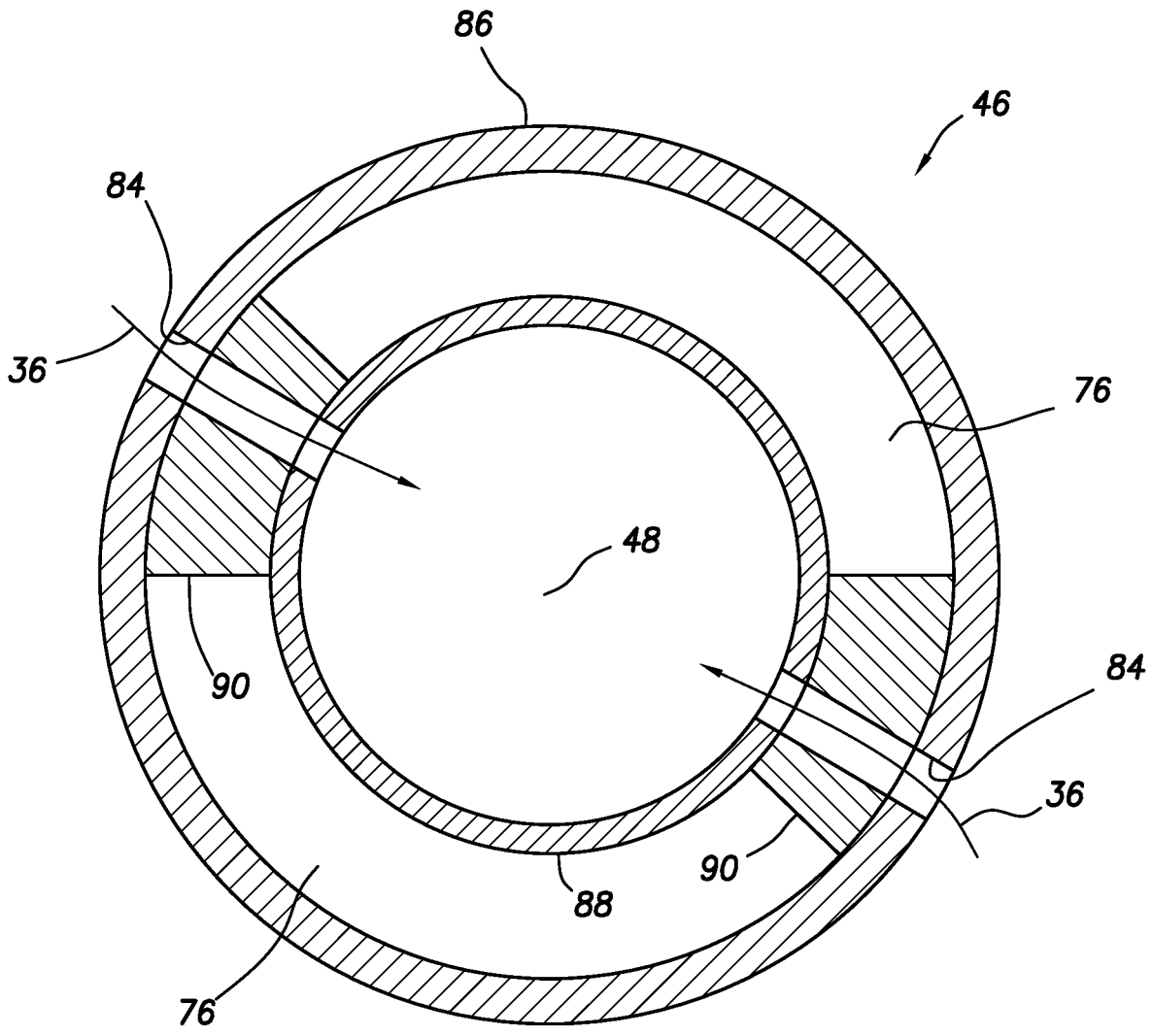
FIG. 8 is a representative cross-sectional view of an intake device of the intake section, taken along line 8-8 of FIG. 7.

Referring additionally now to FIG. 8, an example of a manner in which the openings 84 and the flow passage 48 can be isolated from the channels 76 is representatively illustrated. FIG. 8 is a lateral cross-sectional view taken along line 8-8 of FIG. 7.

As depicted in FIG. 8, the channels 76 extend longitudinally through the intake device 46. The channels 76 are formed between a generally tubular outer housing 86 and an inner manifold 88.

In the FIG. 8 example, the inner manifold 88 is generally tubular and has extensions or splines 90 extending radially outwardly therefrom. The splines 90 extend fully radially between the tubular portion of the inner manifold 88 and the outer housing 86. The openings 84 extend radially through the outer housing 86, the splines 90 and the tubular portion of the inner manifold 88.

In some examples, the splines 90 may be integral with the inner manifold 88. For example, the splines 90 could be machined on an outer surface of the inner manifold 88. In other examples, the splines 90 may be separately formed from the inner manifold 88. In any event, the splines 90 provide for isolation of the openings 84 from the channels 76 in the intake device 46.

Referring again to FIG. 7, it may be seen that the inner manifold 88 is closed off at its lower end. A lower end of the inner tube 50 is sealingly received in a bore 92 formed in an upper end of the inner manifold 88. Thus, an interior of the inner manifold 88 forms a lower end of the flow passage 48, which is isolated from the channels 76 and the annulus 54 in the intake device 46.

It may now be fully appreciated that the above disclosure provides significant advancements to the art of separating gas from liquids in fluids produced from a well. In an example described above, the gas separator 32 includes the intake section 40 in which liquids 36 are received into an inner flow passage 48 of the gas separator 32, and the inner flow passage 48 is isolated from one or more channels 76 that receive the produced fluids 20.

More specifically, the above disclosure provides to the art a gas separator 32 for use in a subterranean well. In one example, the gas separator 32 can comprise: an intake section 40 including a first outer housing 86 and an inner manifold 88. Splines 90 extend radially from the inner manifold 88 and engage an interior surface of the first outer housing 86, thereby isolating openings 84 formed in the splines 90 from longitudinal channels 76 extending through the first outer housing 86.

The splines 90 may be integrally formed as part of the inner manifold 88. The splines 90 may be separately formed from the inner manifold 88.

At least one inner tube 50 may be slidingly and sealingly received in the inner manifold 88. The inner tube 50 may be slidingly and sealingly received in an upper connector 64 of the intake section 40.

The inner tube 50 may be outwardly surrounded by a second outer housing 52, whereby an annulus 54 is formed between the inner tube 50 and the second outer housing 52. The annulus 54 may be in fluid communication with the channels 76 in the first outer housing 86.

The inner tube 50 may be longitudinally displaceable relative to the second outer housing 52 while the inner tube 50 is sealingly and slidingly received in the inner manifold 88 and the upper connector 64.

Also described above is a gas separator 32 for use in a subterranean well, which can comprise an intake section 40, a discharge section 44, and multiple intermediate sections 42 connected between the intake section 40 and the discharge section 44.

Each of the intermediate sections 42 may include an upper connector 64 and a lower connector 62. A set of connected upper and lower connectors 64, 62 may provide fluid communication between interiors of inner tubes 50 on either side of the connected connectors 64, 62, and may provide fluid communication between annuli 54 on either side of the connected connectors 64, 62. The annuli 54 may be formed between the inner tubes 50 and respective outer housings 52 surrounding the inner tubes 50.

The inner tubes 50 may be slip fit and sealingly received in the upper and lower connectors 64, 62. Relative longitudinal displacement may be permitted between the inner tubes 50 and the upper and lower connectors 64, 62.

The intake section 40 may comprise an outer housing 86 and an inner manifold 88, and splines 90 may extend radially from the inner manifold 88 and engage an interior surface of the outer housing 86, thereby isolating openings 84 formed in the splines 90 from longitudinal channels 76 extending through the outer housing 86.

At least one inner tube 50 may be slidingly and sealingly received in the inner manifold 88. The inner tube 50 may be slidingly and sealingly received in an upper connector 64 of the intake section 40.

A gas separation system 10 for use in a subterranean well is also described above. In one example, the system 10 can comprise: a completion string 26 including a packer 28, a gas separator 32 and a downhole pump 38. The gas separator 32 is connected between the packer 28 and the downhole pump 38. A first annulus 30 is formed between the gas separator 32 and a wellbore 12. An intake section 40 of the gas separator 32 receives formation fluids 20 via the completion string 26 below the packer 28, a discharge section 44 of the gas separator 32 discharges gas 34 and liquids 36 into the first annulus 30 above the packer 28, the intake section 40 receives the liquids 36 from the first annulus 30 above the packer 28, and the downhole pump 38 receives the liquids 36 from the discharge section 44.

The intake section 40 may include a first outer housing 86 and an inner manifold 88. Splines 90 may extend radially from the inner manifold 88 and engage an interior surface of the first outer housing 86, thereby isolating openings 84 formed in the splines 90 from longitudinal channels 76 extending through the first outer housing 86.

At least one inner tube 50 may be slidingly and sealingly received in the inner manifold 88. The inner tube 50 may be slidingly and sealingly received in an upper connector 64 of the intake section 40.

The inner tube 50 may be outwardly surrounded by a second outer housing 52, whereby a second annulus 54 is formed between the inner tube 50 and the second outer housing 52, the second annulus 54 being in fluid communication with the channels 76 in the first outer housing 86.

The inner tube 50 may be longitudinally displaceable relative to the second outer housing 52 while the inner tube 50 is sealingly and slidingly received in the inner manifold 88 and the upper connector 64.

The gas separator 32 may include multiple intermediate sections 42 connected between the intake section 40 and the discharge section 44.

Each of the intermediate sections 42 may include an upper connector 64 and a lower connector 62. A set of connected upper and lower connectors 64, 62 may provide fluid communication between interiors of inner tubes 50 on either side of the connected connectors 64, 62, and may provide fluid communication between second annuli 54 on either side of the connected connectors 64, 62.

The second annuli 54 may be formed between the inner tubes 50 and respective outer housings 52 surrounding the inner tubes 50. The inner tubes 50 may be slip fit and sealingly received in the upper and lower connectors 64, 62.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A gas separator for use in a subterranean well, the gas separator comprising:

an intake section including a first outer housing and an inner manifold, wherein splines extend radially from the inner manifold and engage an interior surface of the first outer housing, thereby isolating openings formed in the splines from longitudinal channels extending through the first outer housing, in which the gas separator is configured for unseparated formation fluids flow through the longitudinal channels, and in which the gas separator is configured for formation liquids flow through the openings after separation from formation gases.

2. The gas separator of claim 1, in which the splines are integrally formed as part of the inner manifold.

3. The gas separator of claim 1, in which the splines are separately formed from the inner manifold.

4. The gas separator of claim 1, in which at least one inner tube is slidingly and sealingly received in the inner manifold.

5. The gas separator of claim 4, in which the inner tube is slidingly and sealingly received in an upper connector of the intake section.

6. The gas separator of claim 5, in which the inner tube is outwardly surrounded by a second outer housing, whereby an annulus is formed between the inner tube and the second outer housing, the annulus being in fluid communication with the channels in the first outer housing.

7. The gas separator of claim 6, in which the inner tube is longitudinally displaceable relative to the second outer housing while the inner tube is sealingly and slidingly received in the inner manifold and the upper connector.

8. A gas separator for use in a subterranean well, the gas separator comprising:

an intake section;

a discharge section; and multiple intermediate sections connected between the intake section and the discharge section, in which each intermediate section includes a respective outer housing and a respective inner tube, in which the respective outer housings are threadedly connected in series between the intake section and the discharge section, whereby a combined length of the intermediate sections may be varied by varying a quantity of the intermediate sections, and in which the respective inner tubes are configured to be slidingly and sealingly connected in series when the respective outer housings are threadedly connected.

9. The gas separator of claim 8, in which each of the intermediate sections includes an upper connector and a lower connector, and in which a set of connected upper and lower connectors provides fluid communication between interiors of the inner tubes on either side of the connected connectors, and provides fluid communication between annuli on either side of the connected connectors.

10. The gas separator of claim 9, in which the annuli are formed between the inner tubes and the respective outer housings surrounding the inner tubes.

11. The gas separator of claim 9, in which the inner tubes are slip fit and sealingly received in the upper and lower connectors.

12. The gas separator of claim 9, in which relative longitudinal displacement is permitted between the inner tubes and the upper and lower connectors.

13. The gas separator of claim 8, in which the intake section comprises an outer housing and an inner manifold, and wherein splines extend radially from the inner manifold and engage an interior surface of the outer housing, thereby isolating openings formed in the splines from longitudinal channels extending through the outer housing.

14. The gas separator of claim 13, in which at least one inner tube is slidingly and sealingly received in the inner manifold, and in which the inner tube is slidingly and sealingly received in an upper connector of the intake section.

15. A gas separation system for use in a subterranean well, the system comprising:

a completion string including a packer, a gas separator and a downhole pump, the gas separator being connected between the packer and the downhole pump, wherein a first annulus is formed between the gas separator and a wellbore, an intake section of the gas separator receives formation fluids via the completion string below the packer, a discharge section of the gas separator discharges gas and liquids into the first annulus above the packer, the intake section receives the liquids from the first annulus above the packer, and the downhole pump receives the liquids from the discharge section, in which the intake section includes a first outer housing and an inner manifold, and wherein splines extend radially from the inner manifold and engage an interior surface of the first outer housing, thereby isolating openings formed in the splines from longitudinal channels extending through the first outer housing.

16. The system of claim 15, in which at least one inner tube is slidingly and sealingly received in the inner manifold.

17. The system of claim 16, in which the inner tube is slidingly and sealingly received in an upper connector of the intake section.

18. The system of claim 17, in which the inner tube is outwardly surrounded by a second outer housing, whereby a second annulus is formed between the inner tube and the second outer housing, the second annulus being in fluid communication with the channels in the first outer housing.

19. The system of claim 18, in which the inner tube is longitudinally displaceable relative to the second outer housing while the inner tube is sealingly and slidingly received in the inner manifold and the upper connector.

20. The system of claim 15, in which the gas separator includes multiple intermediate sections connected between the intake section and the discharge section.

21. The system of claim 20, in which each of the intermediate sections includes an upper connector and a lower connector, and in which a set of connected upper and lower connectors provides fluid communication between interiors of inner tubes on either side of the connected connectors, and provides fluid communication between second annuli on either side of the connected connectors.

22. The system of claim 21, in which the second annuli are formed between the inner tubes and respective outer housings surrounding the inner tubes.

23. The system of claim 21, in which the inner tubes are slip fit and sealingly received in the upper and lower connectors.

* * * * *